US010777112B2

(12) United States Patent
Heo et al.

(10) Patent No.: US 10,777,112 B2
(45) Date of Patent: Sep. 15, 2020

(54) DISPLAY DRIVER IC AND DISPLAY APPARATUS INCLUDING THE SAME

(71) Applicant: DB HiTek Co., Ltd, Seoul (KR)

(72) Inventors: Jung Heo, Seoul (KR); Seung Jin Yeo, Gyeonggi-do (KR); Jae Hong Ko, Seoul (KR); Hoon Sang Ryu, Gyeonggi-do (KR); Woo Hyoung Seo, Seoul (KR)

(73) Assignee: DB HiTek Co., Ltd., Seoul (KR)

( * ) Notice: Subject to any disclaimer, the term of this patent is extended or adjusted under 35 U.S.C. 154(b) by 0 days.

(21) Appl. No.: 16/424,232

(22) Filed: May 28, 2019

(65) Prior Publication Data

US 2020/0098297 A1 Mar. 26, 2020

(51) Int. Cl.
*G09G 3/20* (2006.01)

(52) U.S. Cl.
CPC ..... *G09G 3/20* (2013.01); *G09G 2310/0289* (2013.01); *G09G 2310/0291* (2013.01); *G09G 2330/028* (2013.01)

(58) Field of Classification Search
CPC ..... G09G 3/20; G09G 2330/028; G09G 2310/0291; G09G 2310/0289; G09G 2330/021; G09G 3/2092
See application file for complete search history.

(56) References Cited

U.S. PATENT DOCUMENTS 5,726,677 A * 3/1998 Imamura ..... G09G 3/3622 345/537
5,774,106 A * 6/1998 Nitta ..... G09G 3/2011 345/98
7,466,312 B2 * 12/2008 Choi ..... G06F 1/04 327/333
2002/0067328 A1 * 6/2002 Yumoto ..... G09G 3/3685 345/92
2003/0080934 A1 * 5/2003 Ishiyama ..... G09G 3/3655 345/100
2005/0057481 A1 * 3/2005 Chung ..... G09G 3/3677 345/100
2006/0158421 A1 * 7/2006 Masuko ..... G09G 3/3688 345/100
2006/0232539 A1 * 10/2006 Hashimoto ..... G09G 3/3688 345/96
2007/0109288 A1 * 5/2007 Kida ..... G09G 3/3688 345/211
2007/0296682 A1 * 12/2007 Hwang ..... G11C 19/00 345/100
2008/0136809 A1 * 6/2008 Lee ..... G09G 3/3677 345/214
2018/0061307 A1 * 3/2018 Inoue ..... H01L 27/3211

* cited by examiner

*Primary Examiner* — Benyam Ketema
(74) *Attorney, Agent, or Firm* — Andrew D. Fortney; Central California IP Group, P.C.

(57) ABSTRACT

A display driver integrated circuit (DDI) includes a level shifter unit configured to convert a level of a control signal to a voltage in a range that equal to or greater than a first voltage and is equal to or less than a second voltage and output a switch control signal, and a voltage generator including a capacitor and a switch that is turned on or off based on or in response to the switch control signal and configured to generate at least one third voltage.

20 Claims, 5 Drawing Sheets

DISPLAY DRIVER IC AND DISPLAY APPARATUS INCLUDING THE SAME

This application claims the benefit of Korean Patent Application No. 10-2018-0112799, filed on Sep. 20, 2018, which is hereby incorporated by reference as if fully set forth herein.

BACKGROUND OF THE INVENTION

Field of the Invention

Exemplary embodiments of the present invention relate to a display driver integrated circuit (DDI) and a display device including the same.

Discussion of the Related Art

A display driver integrated circuit (DDI) is an integrated circuit for driving a display panel.

A low power driving mode is required in a mobile DDI for supporting an always on display (AOD) mode. For the low power driving mode, operation voltages used in the AOD mode need to be generated in the DDI using voltages supplied from a power management IC (PMIC) during a normal display process or operation.

A DDI may include a negative charge pump to generate operation voltages used in an AOD mode, in which case the size of a switch in the negative charge pump may be greatly increased to be capable of withstanding the load of the operation voltages used in the AOD mode.

The negative charge pump may experience a power loss due to a complementary metal-oxide semiconductor (CMOS) switch. That is, the power loss may be represented by or result from transmission loss from the CMOS switch based on or in response to the load current and the switching losses turn-on and turn-off of the switch.

Since the transmission loss of a switch is dependent upon load current, the transmission loss in the DDI negative charge pump switch is caused by the display panel, and is thus a factor that occurs irrespective of the design of the DDI. However, the switching loss is a power consumption factor of the DDI itself, irrespective of the load current.

As DDI products for supporting an AOD mode have become popular, the size of the switch in the charge pump or DC-DC converter has inevitably increased. Accordingly, power consumption by the charge pump switch may also increase.

SUMMARY OF THE INVENTION

An object of exemplary embodiments is to provide a display driver integrated circuit (DDI) and a display apparatus including the same, characterized by reduced and/or low power consumption.

Additional advantages, objects, and features of the present disclosure will be set forth in part in the description which follows and in part will become apparent to those skilled in the art upon examination of the following or may be learned from practice of the present disclosure. The objectives and other advantages of the present disclosure may be realized and attained by the structure(s) particularly pointed out in the written description and claims hereof as well as the appended drawings.

To achieve these objects and other advantages and in accordance with the purpose(s) of the present disclosure, as embodied and broadly described herein, a display driver integrated circuit (DDI) includes a level shifter unit configured to convert a level of a control signal to a voltage in a range that is equal to or greater than a first voltage and equal to or less than a second voltage and output a switch control signal, and a voltage generator including a capacitor and a switch that is turned on or off based on or in response to the switch control signal and configured to generate at least one third voltage, wherein the level shifter unit includes a level shifter configured to output a first signal (e.g., a level-shifted control signal) based on or in response to the central signal, a buffer configured to buffer the first signal and selectively output a second signal to an output node based on or in response to a buffer control signal, and a pre-charge controller configured to selectively provide a pre-charge voltage to the output node and generate the buffer control signal based on or in response to a pre-charge control signal, wherein the pre-charge voltage is higher than the first voltage and is lower than the second voltage, and the output node is connected to the switch.

The pre-charge controller may include an inverter configured to invert the pre-charge control signal and output the buffer control signal.

The pre-charge controller may include a positive-polarity control terminal configured to receive the pre-charge control signal, a negative-polarity control terminal configured to receive the buffer control signal, an input terminal configured to receive the pre-charge voltage, and an output terminal connected to the output node.

The buffer may receive the first voltage and the second voltage as bias voltages.

The first voltage may be a negative voltage, the second voltage may be a positive voltage, and the pre-charge voltage may be a ground voltage.

When the pre-charge controller provides the pre-charge voltage to the output node, the buffer may not provide the second signal to the output node.

When the pre-charge controller blocks the pre-charge voltage to the output node, the buffer may provide the second signal to the output node.

Prior to a first time at which the control signal transitions from a first level to a second level, the pre-charge controller may provide the pre-charge voltage to the output node, the second signal may not be provided to the output node, and the switch control signal may have the pre-charge voltage.

At the first time, the pre-charge controller may block the pre-charge voltage to the output node, and the buffer may provide the second signal to the output node.

After the first time, the switch control signal may have the second voltage, and the control signal may be at the second level.

At a second time at which the control signal transitions to the first level from the second level, the pre-charge controller may provide the pre-charge voltage to the output node, and the second signal may not be provided to the output node.

At a third time after the second time, the pre-charge controller may block the pre-charge voltage to the output node based on or in response to the pre-charge control signal, and the buffer may provide the second signal to the output node.

From the second time to the third time, the switch control signal may have a voltage that may fall to the pre-charge voltage.

The voltage of the switch control signal may fall to the first voltage after the third time.

In another aspect of the present disclosure, a display driver integrated circuit (DDI) includes a control signal supply unit configured to generate a plurality of control signals, a plurality of level shifter units configured to convert a level of the plurality of control signals and generate a plurality of switch control signals, a voltage generator including switches that are turned on or off based on or in response to the plurality of switch control signals and configured to generate a plurality of voltages based on or in response to a process or operation of the switches, and a gate driver configured to receive at least one of the plurality of voltages, wherein each of the level shifter units includes a level shifter configured to output a first signal based on or in response to a corresponding one of the control signals, a buffer configured to buffer the first signal and selectively output a second signal to an output node based on or in response to a buffer control signal, and a pre-charge controller configured to selectively provide a pre-charge voltage to the output node and generate the buffer control signal based on or in response to the pre-charge control signal, the pre-charge voltage is higher than the first voltage and is lower than the second voltage, and the output node is connected to a corresponding one of the switches.

The pre-charge controller may include an inverter configured to invert the pre-charge control signal and output the buffer control signal, and a positive-polarity control terminal configured to receive the pre-charge control signal, a negative-polarity control terminal configured to receive the buffer control signal, an input terminal configured to receive the pre-charge voltage, and an output terminal connected to the output node.

The first voltage may be a negative voltage, the second voltage may be a positive voltage, and the pre-charge voltage may be a ground voltage.

When the pre-charge controller provides the pre-charge voltage to the output node, the buffer may perform a pre-charge process or operation in which the second signal may not be provided to the output node, and when the pre-charge controller blocks the pre-charge voltage to the output node, the buffer may provide the second signal to the output node.

The pre-charge controller may perform the pre-charge process or operation in a non-overlap time or period between successive assertions of the control signals.

In another aspect of the present disclosure, a display apparatus includes a display panel including gate lines, data lines, and pixels connected to the gate lines and the data lines and in a matrix including rows and columns, and the present DDI, configured to drive the display panel.

BRIEF DESCRIPTION OF THE DRAWINGS

The accompanying drawings, which are included to provide a further understanding of the present disclosure and are incorporated in and constitute a part of this application, illustrate embodiment(s) of the present disclosure and together with the description serve to explain the principle(s) of the present disclosure. In the drawings.

DETAILED DESCRIPTION OF THE INVENTION

Reference will now be made in detail to exemplary embodiments, examples of which are illustrated in the accompanying drawings.

In the following description of various embodiments, it will be understood that, when an element is referred to as being "on" or "under" another element, the element can be directly on another element or can be directly on or under the other element with one or more intervening elements therebetween. In addition, when an element is referred to as being "on" or "under" another element, this may include the upward direction and the downward direction with reference to the other element.

In addition, in the description of the various embodiments, although relative terms such as, for example, "first", "second", "on/upper/above" and "beneath/lower/below may be used to distinguish any one substance or element with another substance or element without requiring or containing any physical or logical relationship or sequence between these substances or elements. In addition, the same reference numbers will be used throughout the drawings to refer to the same or like parts.

The term "comprises", "includes", or "has" as used herein should be interpreted not to exclude other elements but to allow inclusion of other elements since the other elements may be included unless mentioned otherwise. The term "corresponds" as used herein may include at least one of the terms "opposes" and "overlaps".

Figure 1:
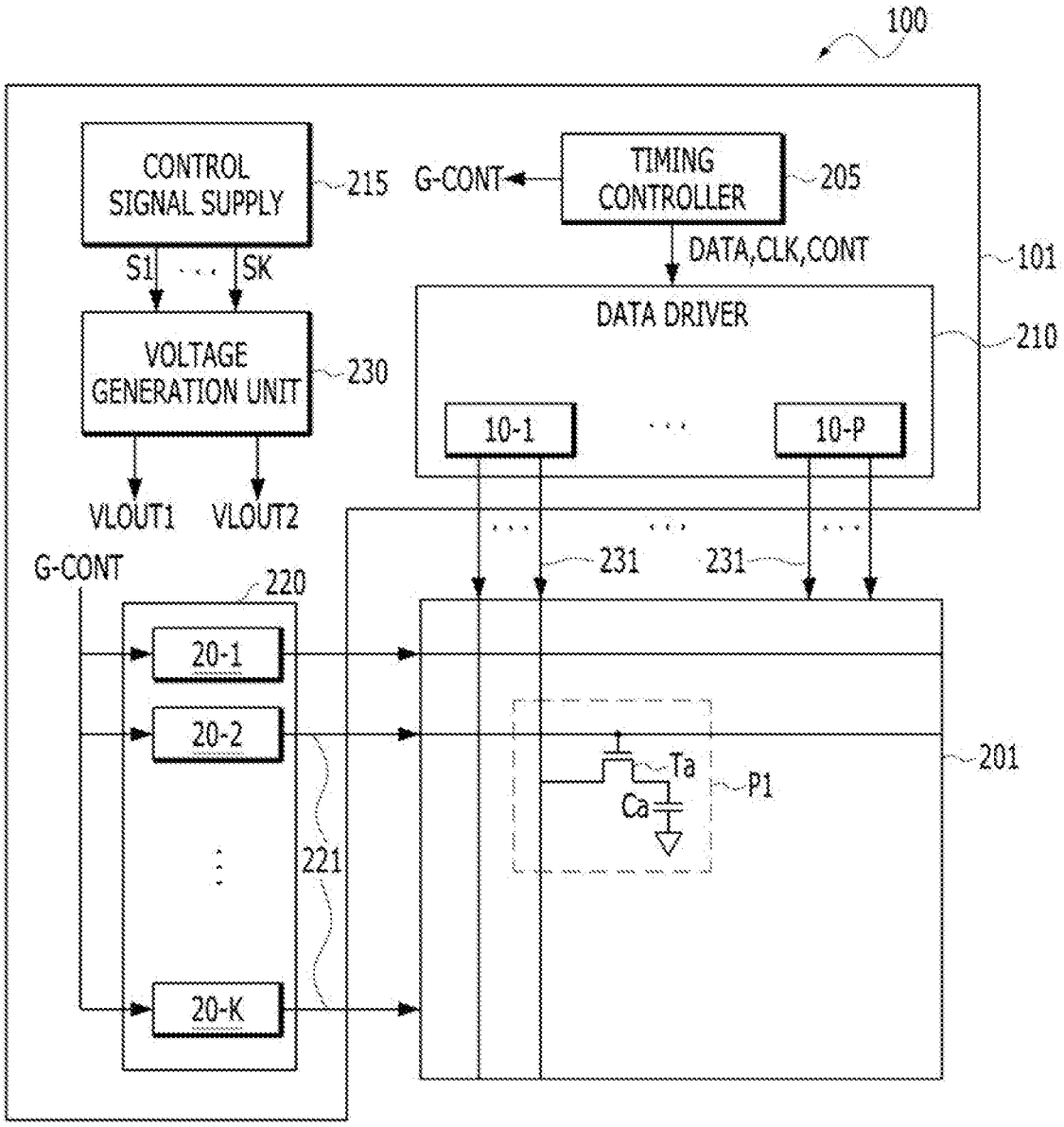
FIG. 1 is a diagram showing the configuration of an exemplary display device including an exemplary display driver integrated circuit (DDI) according to one or more embodiments.

FIG. 1 is a diagram showing the configuration of an exemplary display device 100 including an exemplary display driver integrated circuit (DDI) 101 according to one or more embodiments.

Referring to FIG. 1, the display device 100 may include the DDI 101 and a display panel 201.

The display panel 201 may include data lines constituting a column, gate lines constituting a row, and a plurality of pixels. The pixels may be connected to intersections of the gate lines and the data lines and may be in a matrix including rows and columns.

Each of the pixels P1 may include a transistor Ta connected to a corresponding gate line and a corresponding data line, and a capacitor Ca connected to the transistor Ta.

For example, each pixel P1 may include a red (R) sub-pixel, a green (G) sub-pixel, and a blue (B) sub-pixel, and each of the R, G, and B sub-pixels may include the transistor Ta which is connected to the gate line and the data line, and the capacitor Ca which is connected to the transistor Ta.

The DDI 101 may supply a data driving signal and a gate driving signal. The gate driving signal drives the pixels P1 of the display panel 201.

The DDI 101 may include a timing controller 205, a data driver 210, a gate driver 220, a control signal supply unit 215, and a voltage generation unit 230.

The timing controller 205 may output a clock signal CLK, data DATA, a first control signal CONT configured to control the data driver 210, and a second control signal G_CONT configured to control the gate driver 220.

The clock signal CLK, the data DATA, and the first control signal CONT may be time-divisionally transmitted to each of data drivers 10-1 to 10-P (P>1, P being a natural number) through a single transmission line, but the invention is not limited thereto. According to other embodiments, the clock signal CLK, the data DATA, and the first control signal CONT may be separately transmitted to each of the data drivers 10-1 to 10-P on three separate transmission lines.

For example, the first control signal CONT may include a horizontal start signal and a latch enable signal En (not shown), and the clock signal CLK and the first control signal CONT may be input to a shift register in the data drivers 10-1 to 10-P.

For example, the second control signal G_CONT may include a gate driving signal configured to drive gate lines 221.

The gate driver 220 may include a plurality of gate drivers 20-1 to 20-K (K>1, K being a natural number) configured to drive a corresponding one of the gate lines 221, and the gate driving signals may control the transistor Ta of the pixel P1 to the gate lines 221.

The data driver 210 may drive data lines 231 or channels of the display panel 201, and may include the plurality of data drivers 10-1 to 10-P.

Each of the data drivers 10-1 to 10-P (P>1, P being a natural number) may include a latch unit, a level shifter unit, a decoder, a reference voltage generator, a multiplexer, and an output unit.

The latch unit may store the data DATA from the timing controller based on or in response to a latch signal and may output the stored data DATA. For example, the latch unit may include first latches configured to store the data DATA from the timing controller 205, and second latches configured to (i) receive and store the data from the first latches based on or in response to the latch signal and (ii) output the stored data.

For example, the data driver 210 may further include a shift register that receives a horizontal start signal and shifts the horizontal start signal to generate a latch signal in response to the clock signal CLK. Here, the term "horizontal start signal" may be interchangeably used with "start signal".

The level shifter unit may convert a level (e.g., a voltage level) of the data from the second latches and may output the data with the converted (voltage) level to the decoder unit. For example, the level shifter unit may include a plurality of level shifters corresponding to the second latches.

The decoder may convert a digital signal output from the level shifter unit into an analog signal. Here, the decoder may be interchanged with a digital-analog converter.

The reference voltage generator may generate a plurality of reference voltages (e.g., grayscale voltages). For example, the reference voltage generator may comprise a resistor-string (R-string) including a plurality of resistors that are connected in series between a first power voltage VDD and a ground voltage or ground potential GND, and may generate reference voltages or grayscale voltages, which are divided into a plurality of levels (e.g., 256 levels).

The decoder may select one of the plurality of grayscale voltages the reference voltage generator and may output the selected voltage, based on or in response to the digital signal output from the level shifter unit. For example, the decoder may include the second latches, or a plurality of decoders corresponding to the level shifters.

The multiplexer may output one selected output from the decoder to one of a plurality of amplifiers in the output unit, based on or in response to a polarity control signal.

For example, the multiplexer may include a plurality of multiplexers. The multiplexer may also perform an inversion process or operation (e.g., a dot inversion, a line inversion, etc.) on the display panel 201 or the data being sent thereto.

For example, each of the plurality of multiplexers may provide one output of two selected decoders to one of two amplifiers in the output unit, corresponding to the two selected decoders, based on or in response to the polarity control signal. In addition, each of the plurality of multiplexers may provide the other output of the two selected decoders to the other one of the two amplifiers.

For example, the two selected decoders may be two decoders adjacent to each other among the plurality of decoders, but are not limited thereto.

The output unit may amplify or buffer the analog signal from the decoder and the multiplexer, and may output an amplified or buffered signal.

For example, the output unit may include amplifiers corresponding to the decoders.

The control signal supply unit 215 may generate at least a control signal to control the voltage generation unit 230. For example, the control signal supply unit 215 may generate a plurality of control signals S1 to SK (K>1, K being a natural number).

Figure 2:
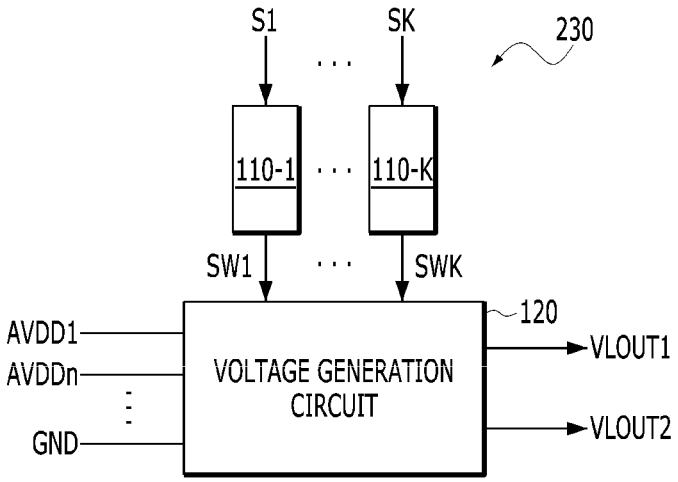
FIG. 2 is a diagram showing an exemplary configuration of the voltage generation unit shown in FIG. 1.

FIG. 2 is a diagram showing the configuration of the voltage generation unit 230 shown in FIG. 1.

Referring to FIG. 2, the voltage generation unit 230 may output a plurality of voltages (e.g., VLOUT1 and VLOUT2) based on or in response to the plurality of control signals S1 to SK. In this case, the plurality of voltages (e.g., VLOUT1 and VLOUT2) may be provided to at least one of the gate driver 220 (FIG. 1) or the data driver 210 (FIG. 1).

The voltage generation unit 230 may include at least one level shifter unit and a voltage generator (e.g., voltage generation circuit 120).

The at least one level shifter unit may convert the level of at least one control signal from the control signal supply unit 215 (FIG. 1) to a voltage range that is equal to or greater than the first voltage VLOUT1 and equal to or less than the second voltage VLOUT2, and the at least one level shifter unit may output a switch control signal having a converted (e.g., higher) voltage level. This is because the voltage level of the control signals S1 to SK are generally too low to drive switches (e.g., switches 21-1 to 21-4 and 22-1 to 22-3 in FIG. 3) in the voltage generation circuit 120, which may be relatively large in comparison to a typical CMOS switch.

For example, the voltage generation unit 230 may include a plurality of level shifter units 110-1 to 110-K (K>1, K being a natural number) corresponding to the plurality of control signals S1 to SK (K>1, K being a natural number).

For example, each of the plurality of level shifter units 110-1 to 110-K (K>1, K being a natural number) may convert a level (e.g., a voltage level) of a corresponding control signal S1 to SK (K>1, K being a natural number) and may output a corresponding switch control signal SW1 to SWK (K>1, K being a natural number) at the converted level (e.g., the converted voltage level).

For example, a first level shifter unit (e.g., the level shifter unit 110-1) may convert the first control signal in the first voltage range into the first switch control signal SW1 in the second voltage range that is different from (e.g., higher than) the first voltage range. For example, the second voltage range may be equal to or greater than the first voltage VLOUT1 and equal to or less than the second voltage VLOUT2.

The voltage generation circuit 120 may receive a plurality of reference voltages AVDD1 to AVDDn and a base voltage (e.g., a ground voltage GND) and may generate at least one voltage (e.g., the first voltage VLOUT1 and/or the second voltage VLOUT2) based on or in response to the plurality of reference voltages AVDD1 to AVDDn, the base voltage GND, and at least one switch control signal.

For example, the voltage generation circuit 120 may include at least one switch that is turned on or off based on or in response to the at least one switch control signal, and at least one capacitor connected to at least one switch. The voltage generation circuit 120 may comprise a charge pump configured to generate at least one voltage, but the present invention is not limited thereto.

Through a switching process or operation of or in at least one switch, at least one of the plurality of reference voltages AVDD1 to AVDDn and the base voltage GND may be charged or stored in or discharged from at least one of the capacitors in the charge pump.

At least one of the plurality of reference voltages AVDD1 to AVDDn and the base voltage GND may be from a power management IC outside the DDI 101. At least another one of the plurality of reference voltages AVDD1 to AVDDn and the base voltage GND may also be generated by a voltage regulator (e.g., a low drop output [LDO] linear regulator) at or in the DDI 101.

Figure 3:
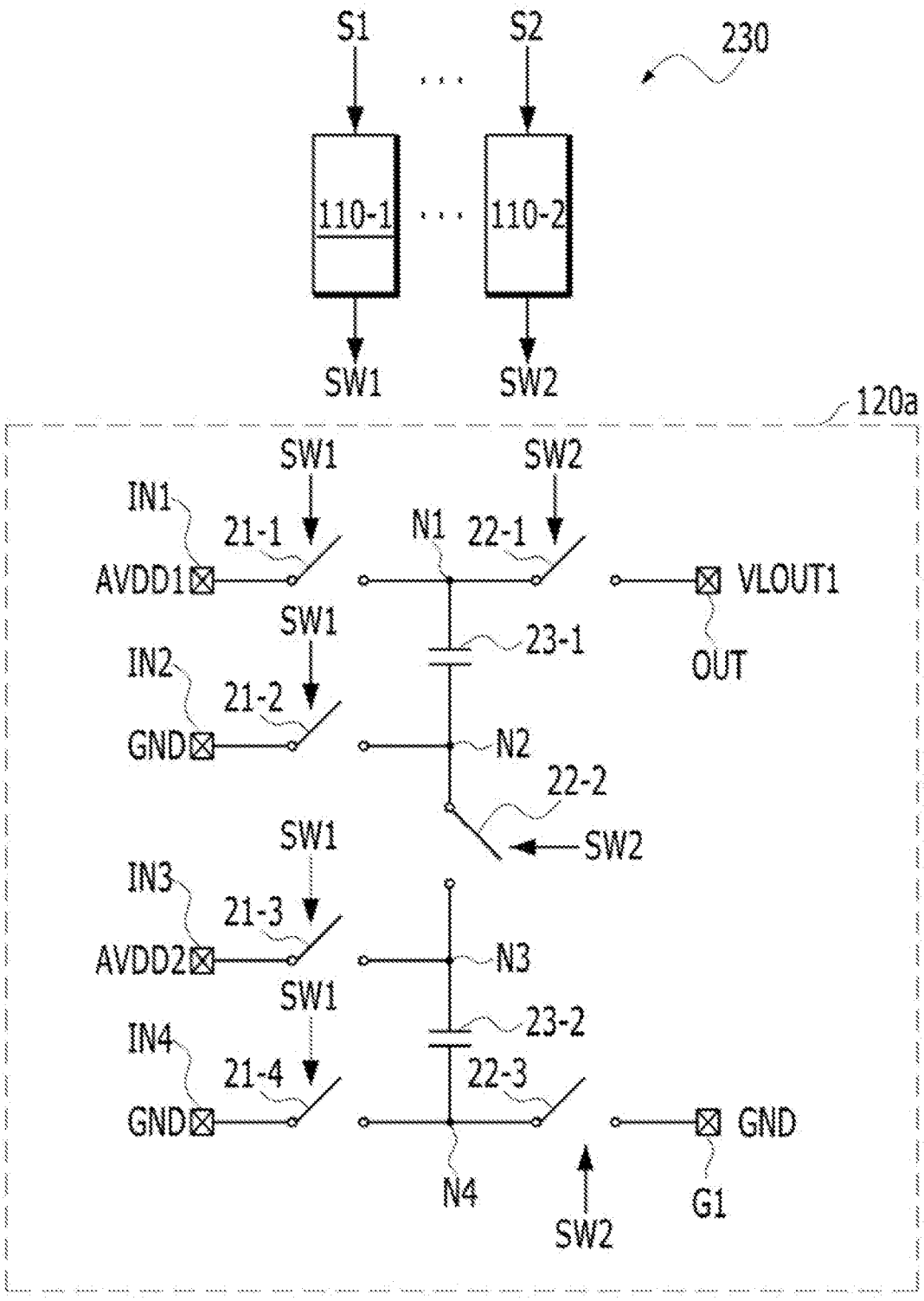
FIG. 3 is a diagram showing an exemplary embodiment of the voltage generation unit shown in FIG. 2.

FIG. 3 is a diagram showing an exemplary voltage generation unit 230 as shown in FIG. 2.

Referring to FIG. 3, the voltage generation unit 230 may include first and second level shifter units 110-1 and 110-2, and a first voltage generation circuit 120*a*.

The first level shifter unit 110-1 may convert the voltage level of the first control signal S1 and may output the first switch control signal SW1 at the converted voltage level.

The second level shifter unit 110-2 may convert the voltage level of the second control signal S2 and may output the second switch control signal SW2 at the converted voltage level.

The first voltage generation circuit 120*a* may include first to fourth switches 21-1 to 21-4, first and second capacitors 23-1 and 23-2, and fifth to seventh switches 22-1 to 22-3.

The first switch 21-1 may be between (e.g., connected to) an input terminal IN1 (or a first power source configured to provide the first reference voltage AVDD1) to which the first reference voltage AVDD1 is provided, and one terminal (or a first node N1) of the first capacitor 23-1.

The second switch 21-2 may be between (e.g., connected to) an input terminal IN2 to which the ground voltage GND is provided, and another terminal (or a second node N2) of the first capacitor 23-1.

The third switch 21-3 may be between (e.g., connected to) an input terminal IN3 (or a second power source configured to provide the second reference voltage AVDD2), to which the second reference voltage AVDD2 is provided, and one terminal (or a third node N3) of the second capacitor 23-2.

The fourth switch 21-4 may be between (e.g., connected to) the input terminal IN4 to which the ground voltage GND is provided, and another terminal (or a fourth node N4) of the second capacitor 23-2.

The fifth switch 22-1 may be between (e.g., connected to) one terminal (or the first node N1) of the first capacitor 23-1, and the output terminal OUT, which provides the output voltage VLOUT1.

The sixth switch 22-2 may be between (e.g., connected to) the other terminal (or the second node N2) of the first capacitor 23-1 and the one terminal (e.g., the third node N3) of the second capacitor 23-2.

The seventh switch 22-3 may be between (e.g., connected to) the other terminal (or the fourth node N4) of the second capacitor 23-2 and an input terminal G1, which receives the ground voltage GND.

The first to fourth switches 21-1 to 21-4 may be controlled based on or in response to the first switch control signal SW1, and the fifth to seventh switches 22-1 to 22-3 may be controlled based on or in response to the second switch control signal SW2.

For example, each of the first to seventh switches 21-1 to 21-4 and 22-1 to 22-3 may comprise a P-type or N-type transistor (e.g., a MOS transistor).

In a first process or operation of the first voltage generation circuit 120*a*, the first to fourth switches 21-1 to 21-4 may be turned on, and the fifth to seventh switches 22-1 to 22-3 may be turned off.

In the first process or operation, the first capacitor 23-1 may be charged with the first reference voltage AVVD1 and the second capacitor 23-2 may be charged with the second reference voltage AVVD2.

In a second process or operation of the first voltage generation circuit 120*a*, the first to fourth switches 21-1 to 21-4 may be turned off, and the fifth to seventh switches 22-1 to 22-3 may be turned on.

In the second process or operation, the sum of the first reference voltage AVVD1 on the first capacitor 23-1 and the second reference voltage AVVD2 on the second capacitor 23-2 may be provided to the output terminal OUT of the first voltage generation circuit 120*a*. Accordingly, the first voltage generation circuit 120*a* may generate the first voltage VLOUT1 and may output the first voltage VLOUT1 to the output terminal OUT.

To prevent a short circuit (e.g., a large current flow) between the first process or operation and the second process or operation, a non-overlap time or period (e.g., see FIG. 5) may be present between assertion of the control signal SW1 and assertion of the control signal SW2, and pre-charge processes or operations A1 and A2 may be performed in the non-overlap time or period.

The first voltage generation circuit 120*a* described with reference to FIG. 3 may be one component in the voltage generation circuit 120, and the voltage generation circuit 120 may further include another voltage generation unit other than the first voltage generation circuit 120*a*.

For example, the voltage generation circuit 120 may further include a second voltage generation circuit including a plurality of switches and a plurality of capacitors, and may charge a plurality of capacitors with at least one reference voltage using at least one of the plurality of reference voltages AVDD1 to AVDDn, the base voltage GND, and at least one switch control signal. In addition, the voltage generation circuit may output the voltage on at least one of the plurality of capacitors as the second voltage VLOUT2 through an output terminal.

Figure 4A:
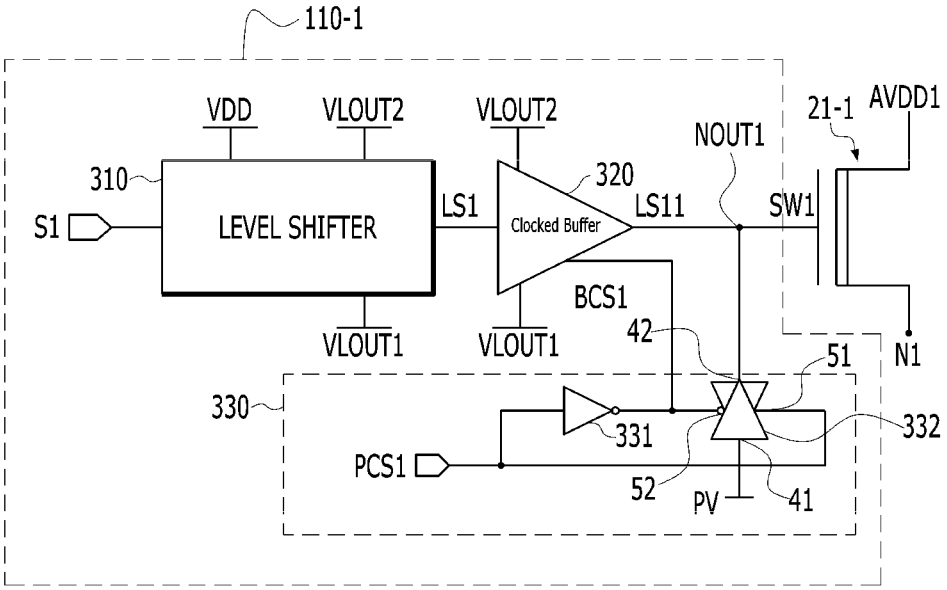
FIG. 4A shows an exemplary embodiment of the first level shifter unit shown in FIG. 3.

FIG. 4A shows an exemplary embodiment of the first level shifter unit 110-1 shown in FIG. 3.

Referring to FIG. 4A, the first level shifter unit 110-1 may include a level shifter 310, a buffer 320, and a pre-charge controller 330.

The level shifter 310 may convert a voltage level of the first control signal S1 and may output a first signal LS1 at a converted voltage level.

For example, the first voltage VLOUT1 and the second voltage VLOUT2 may be provided as bias voltages to the level shifter 310. Here, the first voltage VLOUT1 may be lower than the second voltage VLOUT2 (VLOUT1<VLOUT2). The first and second voltages VLOUT1 and VLOUT2 generated by the voltage generation circuit 120 (FIG. 2) may be provided as bias voltages to the level shifter 310.

For example, the first voltage VLOUT1 may be a negative voltage and the second voltage VLOUT2 may be a positive voltage, but the present disclosure is not limited thereto. According to other embodiments, each of the first voltage VLOUT1 and the second voltage VLOUT2 may be a positive voltage. According to further embodiments, the first voltage VLOUT1 may be a ground voltage and the second voltage VLOUT2 may be a positive voltage.

The level shifter 310 may output a signal (e.g., LS1) in a level-shifted voltage range based on or in response to the first control signal S1. In such a case, the level-shifted voltage range may be from the first voltage VLOUT1 to the second voltage VLOUT2.

For example, when the first control signal S1 is at a first level, the level shifter 310 may output the signal LS1 at the first voltage VLOUT1.

When the first control signal S1 is at a second level, the signal LS1 from the level shifter 310 may be the second voltage VLOUT2.

When the first control signal S1 transitions back to the first level from the second level, the signal LS1 from the level shifter 310 may be pulled-down to the first voltage VLOUT1.

The buffer 320 may selectively output a second signal LS11 based on or in response to the first signal LS1 and a buffer control signal BCS1 to an output node NOUT1 of the first level shifter unit 110-1. The output node NOUT1 may be a node to which an output terminal of the buffer 320 and a switch (e.g., the switch 21-1 or a gate of the switch) are connected.

For example, the first and second voltages VLOUT1 and VLOUT2 from the voltage generation circuit 120 may be provided as bias voltages to the buffer 320.

The first switch control signal SW1 may be output to a gate of a switch (e.g., the switch 21-1) on the output node NOUT1 of the first level shifter unit 110-1.

A process or operation of the buffer 320 may be controlled based on or in response to a buffer control signal BCS from the pre-charge controller 330. For example, the buffer 320 may comprise a clocked buffer configured to output the second signal LS11 in response to the buffer control signal BCS1.

The pre-charge controller 330 may generate the buffer control signal BCS1 based on or in response to a pre-charge control signal PCS1.

The buffer 320 may operate in a normal mode or a high impedance mode, based on or in response to the buffer control signal BCS1.

In the normal mode, the buffer 320 may buffer the output LS1 of the level shifter 310 and may provide the buffered signal LS11 to the output node NOUT1 of the first level shifter unit 110-1.

For example, when the pre-charge control signal PCS1 is at a first level (e.g., a low binary logic level), the buffer control signal BCS1 may be at a second level (e.g., a high binary logic level), and the buffer 320 may operate normally.

In the high impedance mode, the output LS11 of the buffer 320 may enter a high impedance (e.g., "hi-Z") state based on or in response to the buffer control signal BCS1. Accordingly, the output node NOUT1 of the first level shifter unit 110-1 may float (e.g., may not be controlled by the buffer 320).

For example, when the pre-charge control signal PCS1 is at a second binary logic level and the buffer control signal BCS1 is at a first binary logic level, the output terminal NOUT1 of the buffer 320 may float (e.g., be electrically disconnected from the first level shifter unit 110-1) based on or in response to the buffer control signal BCS1.

The pre-charge controller 330 may selectively provide a pre-charge voltage PV to the output node NOUT1 based on or in response to the pre-charge control signal PCS1 and may generate the buffer control signal BCS1 based on or in response to the pre-charge control signal PCS1.

The pre-charge controller 330 may adjust the voltage of the output node NOUT1 of the first level shifter unit 110-1 to the pre-charge voltage PV based on or in response to the pre-charge control signal PCS1. For example, the pre-charge voltage PV may be higher than the first voltage VLOUT1 and may be lower than the second voltage VLOUT2 (VLOUT1<PV<VLOUT2). For example, the pre-charge voltage PV may be a ground voltage.

For example, when the pre-charge controller 330 provides the pre-charge voltage PV to the output node NOUT1, the buffer 320 may not provide the second signal LS11 to the output node NOUT1. On other hand, for example, when the pre-charge controller 330 blocks the transmission of the pre-charge voltage PV to the output node NOUT1, the buffer 320 may provide the second signal LS11 to the output node NOUT1.

For example, the pre-charge controller 330 may include an inverter 331 and a transmission gate 332.

The inverter 331 may invert the pre-charge control signal PCS1 and may output the buffer control signal BCS1 based on or in response to the pre-charge control signal PCS1.

The transmission gate 332 may include an input terminal 41, an output terminal 42, a positive-polarity control terminal 51, and a negative-polarity control terminal 52.

For example, the transmission gate 332 may be a complementary metal-oxide semiconductor (CMOS) transmission gate, including an NMOS transistor and a PMOS transistor. The positive-polarity control terminal 51 may be or comprise the gate of the NMOS transistor, and the negative-polarity control terminal 52 may be or comprise the gate of the PMOS transistor.

The pre-charge voltage PV may be provided to the input terminal 41 of the transmission gate 332, and the output terminal 42 of the transmission gate 332 may be connected to the output node NOUT1 of the first level shifter unit 110-1.

The output of the inverter 331 may be provided to the negative-polarity control terminal 52 of the transmission gate 332, and the pre-charge control signal PCS1 may be provided to the positive-polarity control terminal 51.

For example, when the pre-charge control signal PCS1 is at a second binary logic level, the transmission gate 332 may transmit the pre-charge voltage PV to the output node NOUT1 of the first level shifter unit 110-1. On the other hand, when the pre-charge control signal PCS1 is at a first level, the transmission gate 332 may close, and transmission of the pre-charge voltage PV to the output node NOUT1 of the first level shifter unit 110-1 may be blocked.

Figure 4B:
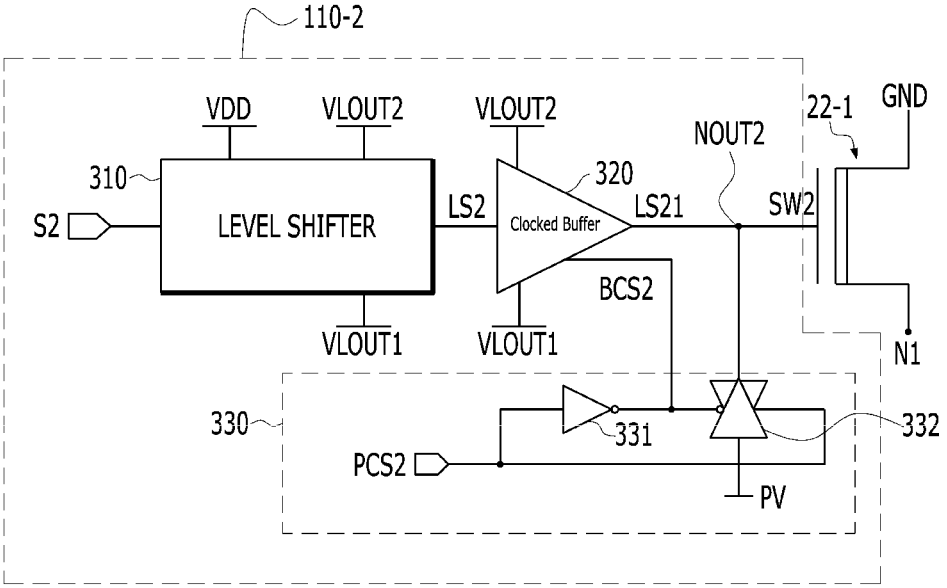
FIG. 4B is a diagram showing an exemplary embodiment of the second level shifter unit shown in FIG. 3.

FIG. 4B is a diagram showing an exemplary embodiment of the second level shifter unit 110-2 shown in FIG. 3.

Referring to FIG. 4B, the second level shifter unit 110-2 may include another level shifter 310, another buffer 320, and another pre-charge controller 330. The second level shifter unit 110-2 may have the same configuration as that of the first level shifter 110-1. Each of the plurality of level shifter units 110-1 to 110-K shown in FIG. 2 may have the same configuration as that of the first level shifter unit shown in FIG. 4A, and the description of FIG. 4A may be applied thereto.

However, the level shifter 310 of the second level shifter unit 110-2 of FIG. 4B may output a first signal LS2 in a level-shifted voltage range based on or in response to the second control signal S2. In such a case, the level-shifted voltage range may be from the first voltage VLOUT1 to the second voltage VLOUT2.

The pre-charge controller 330 of FIG. 4B may generate a buffer control signal BCS2 based on or in response to a pre-charge control signal PCS2, and the buffer 320 of FIG. 4B may output a second (buffered) signal LS21 based on or in response to the buffered first signal LS2.

The pre-charge controller 330 of FIG. 4B may selectively provide the pre-charge voltage PV or the second signal LS21 from the buffer 320 to an output node NOUT2 of the second level shifter unit 110-2 based on or in response to the pre-charge control signal PCS2, and the output node NOUT2 may output the second switch control signal SW2 to a gate of a switch (e.g., the switch 22-1).

Figure 5:
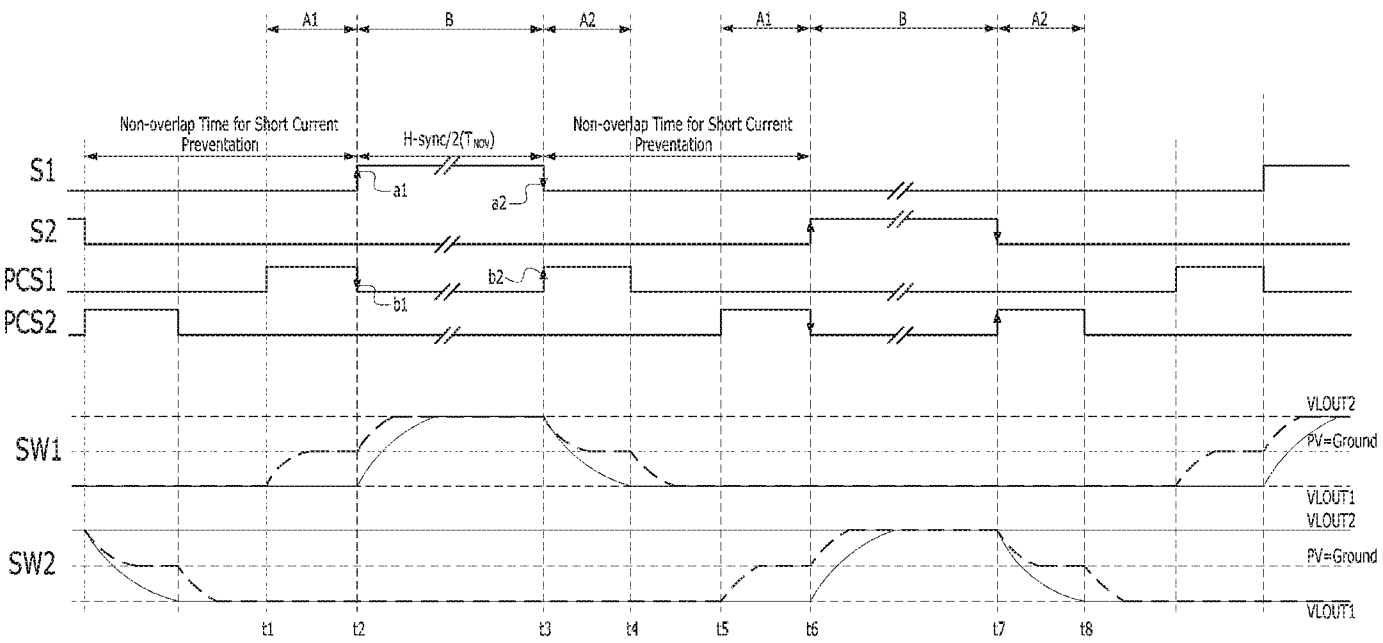
FIG. 5 is an exemplary timing diagram of control signals, pre-charge control signals, and switch control signals.

FIG. 5 is a timing diagram of control signals S1 and S2, pre-charge control signals PCS1 and PCS2, and switch control signals SW1 and SW2.

Referring to FIG. 5, when the pre-charge control signals PCS1 and PCS2 are at a second level (e.g., a high binary logic level), the first and second level shifter units 110-1 and 110-2 (FIGS. 4A-B) may perform a pre-charge process or operation. Hereinafter, the periods during which the pre-charge process or operation is performed are referred to as "pre-charge periods A1 and A2".

In the pre-charge periods A1 and A2, an output terminal from the buffer 320 may float (e.g., be electrically disconnected from the respective first or second level shifter unit 110-1 or 110-2), and the pre-charge voltage PV may be transmitted to the output nodes NOUT1 and NOUT2 of the first and second level shifter units 110-1 and 110-2 by the transmission gate 332.

The first pre-charge period A1 may be before a first period B, and the second pre-charge period A2 may be after the first period B.

The first period B may be a period in which the control signals S1 and S2 are at a second (e.g., binary logic) level and the pre-charge control signals PCS1 and PCS2 are at a first (e.g., complementary binary logic) level.

For example, a start time t1 or t5 of the first pre-charge period A1 may precede a first time t2 or t6, respectively, in which the control signals S1 and S2 transition to the second level from the first level. For example, an end time of the transition may be synchronized with the first time t2 or t6.

For example, the pre-charge control signals PCS1 and PCS2 may transition to a first level from a second level at the end time t2 of the first pre-charge period A1.

For example, a first falling edge b1 of the pre-charge control signals PCS1 and PCS2 may be synchronized with a first rising edge a1 of the control signals S1 and S2.

In the first pre-charge period A1, a voltage of the switch control signals SW1 and SW2 from the first and second level shifter units 110-1 and 110-2 may rise from the first voltage VLOUT1 to the pre-charge voltage PV.

In the first period B, the pre-charge voltage PV may be blocked from the output nodes NOUT1 and NOUT2 of the first and second level shifter units 110-1 and 110-2 by the transmission gate 332, and the buffer 320 may operate normally. Accordingly, the voltage of the switch control signals SW1 and SW2 on the output nodes NOUT1 and NOUT2 from the first and second level shifter units 110-1 and 110-2 may rise from the pre-charge voltage PV to the second voltage VLOUT2.

For example, the second pre-charge period A2 may be after a second time t3 or t7, in which the (voltage) level of the control signals S1 and S2 transitions to the first binary logic level from the second binary logic level.

For example, a start point of the second pre-charge period A2 may be synchronized with the second time t3 or t7, in which the control signals S1 and S2 transition to the first binary logic level from the second binary logic level.

For example, a first rising edge b2 of the pre-charge control signals PCS1 and PCS2 may be synchronized with a first falling edge a2 of the control signals S1 and S2. The first rising edge b2 of the pre-charge control signals PCS1 and PCS2 may correspond to a logic level transition occurring during a period of time (t3-t2) after the first falling edge b1 of the pre-charge control signals PCS1 and PCS2, and the first falling edge a2 of the control signals S1 and S2 may correspond to a logic level transition occurring during the period of time (t3-t2) after the first rising edge a1 of the control signals S1 and S2.

An end time t4 or t8 of the second pre-charge period A2 may be synchronized with a second falling edge of the pre-charge control signals PCS1 and PCS2, after the second time t3 or t7. Here, the second falling edge of the pre-charge control signals PCS1 and PCS2 may correspond to the logic level transition following the first falling edge b1.

In the second pre-charge period A2, the voltage of the switch control signals SW1 and SW2 from the first and second level shifter units 110-1 and 110-2 may fall to the pre-charge voltage PV from the second voltage VLOUT2.

In the first and second pre-charge periods A1 and A2, the pre-charge voltage PV from the transmission gate 332 is provided to the output nodes NOUT1 and NOUT2 of the first and second level shifter units 110-1 and 110-2, and thus, a current based on or in response to a difference between the pre-charge voltage PV and the first voltage VLOUT1 or the second voltage VLOUT2 may flow.

For example, prior to the first time t2 or t6, the pre-charge voltage PV may be provided to the output nodes NOUT1 and NOUT2 by the pre-charge controller 330 (FIGS. 4A-B), the outputs LS11 and LS21 of the buffer 320 may not be provided to the output nodes NOUT1 and NOUT2, and the voltage of the switch control signals SW1 and SW2 may rise to the pre-charge voltage PV.

In synchronization with the first time t2 or t6, transmission of the pre-charge voltage PV to the output nodes NOUT1 and NOUT2 may be blocked by the pre-charge controller 330, and the buffer 320 may provide the second signals LS11 and LS21 to the output nodes NOUT1 and NOUT2.

After the first time t2 or t6, the voltage of the switch control signals SW1 and SW2 may rise to the second voltage VLOUT2 in the period B, in which the control signal S1 or S2 is at a second level.

In synchronization with the second time t3 or t7, the pre-charge voltage PV may be provided to the output nodes NOUT1 and NOUT2 by the pre-charge controller 330, and the output of the buffer 320 may not be provided to the output nodes NOUT1 and NOUT2.

At the third time t4 or t8 after the second time t3 or t7, respectively, the pre-charge controller 330 may block transmission of the pre-charge voltage PV to the output nodes NOUT1 and NOUT2 based on or in response to the pre-charge control signals PCS1 and PCS2, and the buffer 320 may provide the second signals LS11 and LS21 to the output nodes NOUT1 and NOUT2.

At the second time t3 or t7, the voltage of the switch control signals SW1 and SW2 may fall to the pre-charge voltage PV in the period A2.

After the third time t4 or t8, the voltage of the switch control signals SW1 and SW2 may fall to the first voltage VLOUT1.

A description of the first time t2 and t6 may be interchangeably expressed with the first falling edge b1 of the pre-charge control signals PCS1 and PCS2, and a description of the second time t3 or t7 may be interchangeably expressed with the first rising edge b2 of the pre-charge control signals PCS1 and PCS2.

In FIG. 5, a dotted line (hereinafter, referred to as "CASE 1") of the switch control signals SW1 and SW2 indicates a waveform of a switch control signal according to the present invention, and a solid line (hereinafter, referred to as "CASE 2") indicates a waveform of a switch control signal when the pre-charge controller 330 is omitted from the first and second level shifter units 110-1 and 110-2.

Referring to FIG. 5, compared with CASE 2, current consumption used to generate the switch control signals SW1 and SW2 may be reduced by half in CASE 1. Accordingly, DDI design for low power consumption may be achieved. Thus, the power consumption burden that accompanies an increase in the number of switches in the voltage generator may be alleviated.

Without reducing the current flowing in the switches of the voltage generator, the power consumed by the level shifter consumes most of the driving consumption power. However, the first and second voltages VLOUT1 and VLOUT2 as bias voltages to the level shifter 310 may be generated using a pre-charge method and/or a pre-charge voltage (e.g., a ground voltage), thereby reducing current used to transition between the first and second voltages VLOUT1 and VLOUT2.

According to various embodiments of the present invention, current consumption may be reduced, thereby achieving low power consumption.

It will be apparent to those skilled in the art that various modifications and variations can be made in the present disclosure without departing from the spirit or scope of the invention. Thus, it is intended that the present disclosure cover the modifications and variations of this invention provided they come within the scope of the appended claims and their equivalents.

What is claimed is:

1. A display driver integrated circuit (DDI) comprising:

a level shifter unit configured to convert a level of a control signal to a voltage in a range that is equal to or greater than a first voltage and equal to or less than a second voltage and output a switch control signal; and a voltage generator including a capacitor and a switch that is turned on or off based on or in response to the switch control signal and configured to generate at least one third voltage, wherein the level shifter unit includes:

a level shifter configured to output a first signal based on or in response to the control signal;

a buffer configured to buffer the first signal and selectively output a second signal to an output node based on or in response to a buffer control signal; and a pre-charge controller configured to selectively provide a pre-charge voltage to the output node and generate the buffer control signal based on or in response to a pre-charge control signal, the pre-charge voltage is higher than the first voltage and is lower than the second voltage, and the output node is connected to the switch.

2. The DDI of claim 1, wherein the pre-charge controller includes an inverter configured to invert the pre-charge control signal and output the buffer control signal.

3. The DDI of claim 2, wherein the pre-charge controller includes a positive-polarity control terminal configured to receive the pre-charge control signal, a negative-polarity control terminal configured to receive the buffer control signal, an input terminal configured to receive the pre-charge voltage, and an output terminal connected to the output node.

4. The DDI of claim 1, wherein the buffer receives the first voltage and the second voltage as bias voltages.

5. The DDI of claim 1, wherein the first voltage is a negative voltage, the second voltage is a positive voltage, and the pre-charge voltage is a ground voltage.

6. The DDI of claim 1, wherein when the pre-charge controller provides the pre-charge voltage to the output node, the buffer does not provide the second signal to the output node.

7. The DDI of claim 1, wherein, when the pre-charge controller blocks the pre-charge voltage to the output node, the buffer provides the second signal to the output node.

8. The DDI of claim 1, wherein, prior to a first time at which the control signal transitions from a first level to a second level, the pre-charge controller provides the pre-charge voltage to the output node, the second signal is not provided to the output node, and the switch control signal has the pre-charge voltage.

9. The DDI of claim 1, wherein at the first time, the pre-charge controller blocks the pre-charge voltage to the output node, and the buffer provides the second signal to the output node.

10. The DDI of claim 9, wherein, after the first time, the switch control signal has the second voltage and the control signal is at the second level.

11. The DDI of claim 1, wherein at a second time at which the control signal transitions to the first level from the second level, the pre-charge controller provides the pre-charge voltage to the output node, and the second signal is not provided to the output node.

12. The DDI of claim 11, wherein, at a third time after the second time, the pre-charge controller blocks the pre-charge voltage to the output node based on or in response to the pre-charge control signal, and the buffer provides the second signal to the output node.

13. The DDI of claim 12, wherein from the second time to the third time, the switch control signal has a voltage that falls to the pre-charge voltage.

14. The DDI of claim 13, wherein the voltage of the switch control signal falls to the first voltage after the third time.

15. A display driver integrated circuit (DDI) comprising:

a control signal supply unit configured to generate a plurality of control signals;

a plurality of level shifter units configured to convert a level of the plurality of control signals and generate a plurality of switch control signals;

a voltage generator including switches that are turned on or off based on or in response to the plurality of switch control signals and configured to generate a plurality of voltages based on or in response to a process or operation of the switches; and a gate driver configured to receive at least one of the plurality of voltages, wherein each of the level shifter units includes:

a level shifter configured to output a first signal based on or in response to a corresponding one of the control signals;

a buffer configured to buffer the first signal and selectively output a second signal to an output node based on or in response to a buffer control signal; and a pre-charge controller configured to selectively provide a pre-charge voltage to the output node and generate the buffer control signal based on or in response to the pre-charge control signal, the pre-charge voltage is higher than the first voltage and is lower than the second voltage, and the output node is connected to a corresponding one of the switches.

16. The DDI of claim 15, wherein the pre-charge controller includes:

an inverter configured to invert the pre-charge control signal and output the buffer control signal; and a positive-polarity control terminal configured to receive the pre-charge control signal, a negative-polarity control terminal configured to receive the buffer control signal, an input terminal configured to receive the pre-charge voltage, and an output terminal connected to the output node.

17. The DDI of claim 15, wherein the first voltage is a negative voltage, the second voltage is a positive voltage, and the pre-charge voltage is a ground voltage.

18. The DDI of claim 15, wherein when the pre-charge controller provides the pre-charge voltage to the output node, the buffer performs a pre-charge process or operation in which the second signal is not provided to the output node, and when the pre-charge controller blocks the pre-charge voltage to the output node, the buffer provides the second signal to the output node.

19. The DDI of claim 18, wherein the pre-charge controller performs pre-charge process or operation in a non-overlap time or period between successive assertions of the control signals.

20. A display apparatus comprising:

a display panel including gate lines, data lines, and pixels connected to the gate lines and the data lines and in a matrix including rows and columns; and the DDI of claim 1, configured to drive the display panel.

* * * * *